United States Patent [19]

Omori

[11] Patent Number: 4,613,071

[45] Date of Patent: Sep. 23, 1986

[54] STEAM HEATING EQUIPMENT WITH CONDENSATE VESSEL AND RETURN LINE

[75] Inventor: Toshiaki Omori, Tokyo, Japan

[73] Assignee: Tokyo Gas Company, Ltd., Japan

[21] Appl. No.: 715,473

[22] Filed: Mar. 25, 1985

[30] Foreign Application Priority Data

Mar. 23, 1984 [JP] Japan ..... 59-56939

[51] Int. Cl.[4] ..... F24D 1/00

[52] U.S. Cl. ..... 237/9 R; 237/67

[58] Field of Search ..... 237/67, 60, 59, 56, 237/58, 64, 9 R

[56] References Cited

U.S. PATENT DOCUMENTS 1,008,285 11/1911 Rouquaud ..... 237/60

FOREIGN PATENT DOCUMENTS 955356 1/1957 Fed. Rep. of Germany ..... 237/67

572448 1/1958 Italy ..... 237/67

*Primary Examiner*—Henry Bennett

*Attorney, Agent, or Firm*—McGlew and Tuttle

[57] ABSTRACT

Steam heating equipment for the interior of a room recirculating heating fluid after it has condensed in a heat emitter for heating the room. The heat media liquid is sealed in an enclosed steam generator which supplies steam to the heat emitter via a steam conducting pipe. The heat media liquid which has condensed in the emitter by giving up its latent heat to the ambient air, is stored inside a condensed liquid vessel which is under atmospheric pressure. When the heat media liquid inside the steam generator has been depleted to a certain level, the heating of the steam generator is stopped. The heat media liquid which has previously been stored inside the condensed liquid vessel is then recirculated into the steam generator through a liquid circulation pipe which is separate from the aforesaid steam conducting pipe, by utilizing a pressure reduction action within the steam generator causing its cooling. When this liquid circulation has been completed, the cycle of heating up the steam generator again for sending out its steam, is repeated.

7 Claims, 4 Drawing Figures

STEAM HEATING EQUIPMENT WITH CONDENSATE VESSEL AND RETURN LINE

FIELD AND BACKGROUND OF THE INVENTION

The present invention relates in general to heating equipment and in particular to a new and useful steam heating apparatus which utilizes a condensed liquid vessel which is under atmospheric pressure and which is connected to a steam generator through a liquid circulation pipe or return line, for replenishing heat media liquid in the steam generater.

Steam type heating equipment is publicly known wherein water is heated by a steam boiler for the generation of steam which is then introduced into radiators or heat emitters. Latent heat is given off to the ambient air by condensing the steam in the aforesaid radiators or heat emitters and thus heating is achieved. This sort of steam type heating equipment adopts means wherein the condensed water is recirculated to the steam boiler by utilizing a circulation pump. Consequently, most of the noise and trouble of the heating system is due to the circulation pump. Further, electric power must be consumed for operating the circulation pump.

To avoid the circulation pump, steam type heating equipment is known which has a gravity liquid circulation system as shown in FIG. 1.

In FIG. 1, the symbol 01 indicates a steam generator, 02 a heating source and 03 a steam conducting pipe incorporating a heat transfer tube 05 of a heat radiator 04 for receiving saturated steam generated from the steam generator 01. A liquid circulation pipe 06 connects the outlet 09 of heat transfer tube 05 with the aforesaid steam generator 01. A vacuum air valve 07 is connected to outlet 09. Steam generator 01 has a steam outlet 08. a liquid return port 010 contains saturated steam 011. Condensed liquid is shown at 012. When the liquid inside steam generator 01 is heated up by the heating source 02 for generation of saturated steam 011, this saturated steam 011 is sent to the heat transfer tube 05 through the steam conducting pipe 03 for heat exchange with fluid around this heat transfer tube 05 (usually air) and for achieving the heating up effect by giving the condensed latent heat to the surrounding fluid and returning to a liquid phase, while the condensed liquid 012 is returned to the steam generator 01 because of the liquid level difference H between the condensed liquid level inside liquid circulation pipe 06 and that within steam generator 01.

This system, while avoiding the circulation pump, has installation restrictions in that the liquid level inside liquid circulation pipe 6 must be higher than the liquid level inside steam generator 01 by the pressure loss amount H of the pipe channel and further the radiator 04 must be erected on top of the liquid circulation pipe 06. In addition there is a defect of not being able to select a thinner dia pipe for the steam conducting pipe leading from the steam generator 01 to the radiator 04 because the radiator 04 (heat transfer tube 05) must have a small flow resistance since the aforesaid high H can not be set to a very larger value.

For this reason, the conventional gravity type liquid circulation system fails to cope with the increasing demands in recent years for a more compact heat emitter, a thinner diameter for pipe channels and a diversification of equipment.

SUMMARY OF THE INVENTION

The first objective of this invention is to provide steam type heating equipment without adopting a circulation pump, which can use a heat emitter at an optional location. The second objective moreover is to provide steam type heating equipment which can be made more compact and of thinner diameter steam conducting pipes and liquid circulation pipes for connecting the heat emitter to the steam generator.

DESCRIPTION OF THE PREFERRED EMBODIMENTS

This invention adopts a structure consisting of a steam generator having a heating source for achieving the aforesaid objectives, a heat emitter incorporating a heat transfer tube, a steam conducting tube for introducing saturated steam, generated inside the steam generator, to the heat transfer tube within the heat emitter, a condensed liquid vessel exposed to atmospheric pressure for storing liquid phase heat media condensed due to its giving up latent heat to the surroundings while passing through the heat transfer tube inside the heat emitter, a liquid circulation tube connecting the condensed liquid vessel with the steam generator or steam conducting tube. and a control valve installed in the liquid circulation tube. When the heating source is switched on for commencing its heating operation, the working liquid (heat media liquid) inside the steam generator is heated up by its heating source, is turned into saturated steam and is sent to the heat transfer tube inside the heat emitter via the steam conducting tube. The control valve is kept closed at this time of steam generation, for preventing the steam from flowing to the liquid circulation tube when the saturated steam is generated. The satured steam sent into the heat transfer tube gives its latent heat to the fluid around the heat transfer tube (e.g. air) and is condensed. The liquid is then stored inside the condensed liquid vessel after giving up a part of its sensible heat. As mentioned above, the heating operation is continued, and when the water level of working fluid within the steam generator goes down below a certain level as time goes by, the heating source is turned off and the saturated steam generation is stopped. At the same time, the interior of the steam generator starts to cool and the saturated steam therein is condensed and reduced rapidly in pressure, so the control valve (which may be a check valve) is opened, and the condensed liquid inside the condensed liquid vessel is subjected to atmospheric pressure on its liquid surface and is circulated into the steam generator via the liquid circulation pipe due to the differential in pressure. Furthermore, the condensed liquid inside the condensed liquid vessel is circulated back to the steam generator in small amounts via the steam conducting tube from the heat transfer tube at the same time when it is fed back to the steam generator interior via the liquid circulation tube as mentioned above. In this event, if the condensed liquid has been set to a low temperature level for example 30° C. or below, heat may be lost from the surroundings into the transfer tube. This would impair the overall heating effect. In such a case therefor, a counter measure must be provided against the blowing of cool wind from a radiator by switching on or off the operation of a heating fan used in the radiator, by means of a cooling wind preventive switch or controller.

Figure 1:
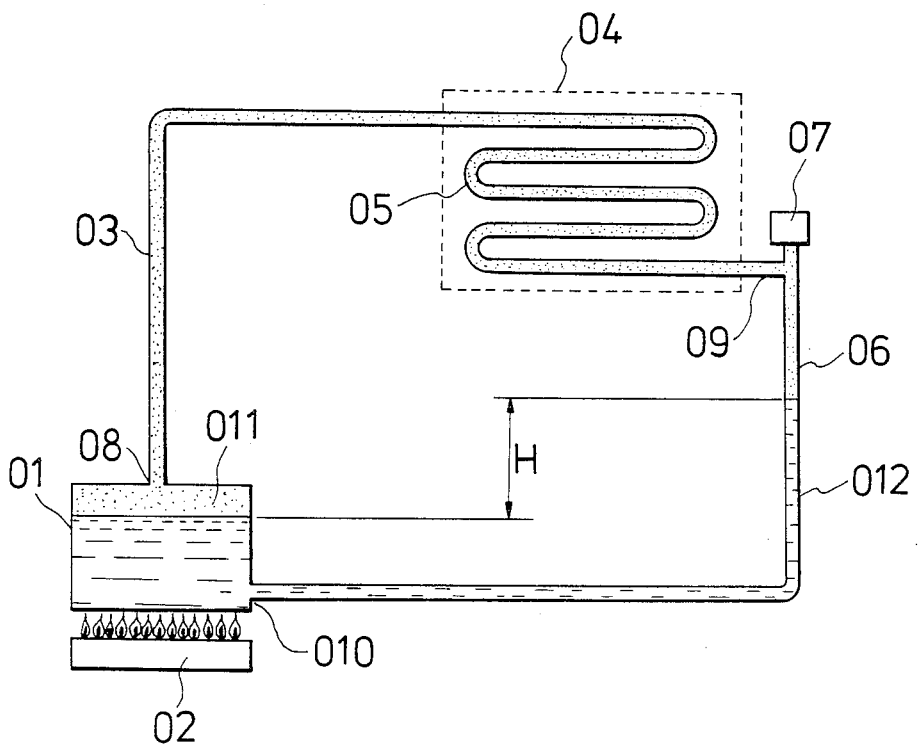
FIG. 1 (PRIOR ART)
FIG. 1 is an explanatory diagram of gravity type steam heating equipment.
Figure 2:
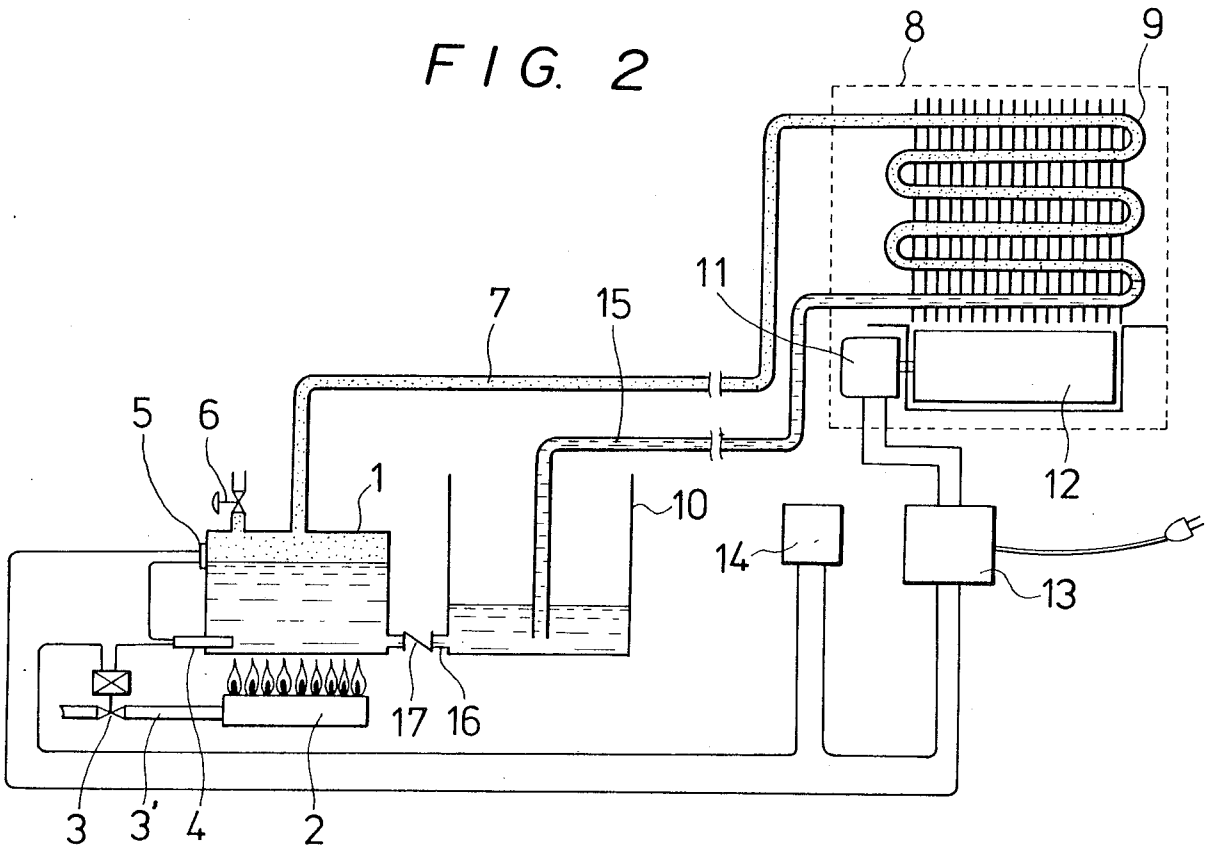
FIG. 2 is a diagram of steam type heating equipment of this invention, showing an embodiment employing a single unit heat emitter (fanned convector)

FIG. 2 indicates an actual example of this invention, where the symbol 1 stands for a steam generator whose interior is hermetically enclosed, 2 a heating source (gas burner), and 3 an electromagnetic valve for controlling the operation of source 3, which is fitted to a fuel supply pipe 3'. The symbol 4 represents a low liquid level sensor attached to the interior of steam generator 1, while 5 is a temperature fuse fitted to the outer wall of steam generator 1. When this temperature fuse 5 is blown, the aforesaid electromagnetic valve 3 is shifted to OFF to stop the heating in case the generator 1 is overheated. The symbol 6 stands for a pressure relief valve which serves to prevent the pressure inside steam generator 1 from rising abnormally high.

The symbol 7 stands for the steam conducting tube or pipe connecting the inlet of finned heat transfer tube 9 inside fanned convector (as a heat emitter) 8, to the steam generator. A condensed liquid vessel is shown at 10 and 11 is a motor for rotating the warm wind fan 12 incorporated inside the fanned convector 8. 13 is a controller with a switch, 14 is a thermostat, 15 is a condensed liquid discharge tube or pipe connecting the outlet of the heat transfer tube 9 with the condensed liquid vessel 10, and 17 is a check valve attached to a liquid circulation tube 16. When the pressure inside steam generator 1 has become lower than atmospheric pressure, valve 17 functions to open for release to the side of steam generator 1 and when the pressure is over atmospheric pressure, valve 17 is kept closed. The liquid circulation tube 16 can be connected to the steam conducting tube 7 by by-passing the fanned convector 8. Moreover, the check valve can be an electromagnetic valve for which opening or closing is controlled by a controller 13. As shown tube 16 is connected between vessel 10 and steam generator 1.

In operation, when the switch of controller 13 is turned on, the electro-magnetic valve 3 is opened to allow the fuel to be fed to the heating source 2 which functions to heat up the steam generator 1. Being heated up by the heating source 2. the working liquid (e.g. water) inside the steam generator 1 is evaporated and this saturated steam is sent out to the heat transfer tube 9 within fanned convector 8 via the steam conducting tube 7. The saturated steam entering into the heat transfer tube 9 gives its latent heat to the fluid or air which has been sent from the warm wind fan 12 and is condensed, and this condensed liquid is stored inside the condensed liquid vessel 10 via the condensed liquid discharge tube 15.

When the heating is advanced as explained above and the liquid level inside steam generator 1 has gone down below a certain level, the low liquid level sensor 4 detects it and sends out a closing signal to the electromagnetic valve 3 for closing it. The heating comes to a stop when the electromagnetic valve 3 is closed, the steam within steam generator 1 is cooled down for condensing the steam inside the steam generator, and because of a pressure reduction action (vacuum action) caused on that occasion, the check valve 17 is opened, and the condensed liquid inside condensed liquid vessel 10 is circulated back to the interior of steam generator 1 via the liquid circulation tube 16.

When the condensed liquid has been circulated back and the working liquid has been filled fully in the steam generator 1, it will be detected by, for instance, a high liquid level sensor and an opening signal will be sent to the electromagnetic valve 3 for restarting the heating operation. The heating is to be carried out by repetition of this pattern, where when the room temperature has reached a set temperature, the thermostat 14 detects it to close the electromagnetic valve 3 while when the room temperature has gone down below the set temperature level, the electromagnetic valve 3 is reopened for continuation of room temperature control. Also, as the means of detecting the working liquid volume which has been fed back to the interior of steam generator 1, such a means is conceivable besides a high liquid level sensor, for instance, that detects the rise of pressure inside steam generator 1 or the drop of liquid level on the side of condensed liquid vessel 10. Further, such a way is also acceptable that, after the condensed liquid has been recovered upto a higher level by the detection position of a low liquid level sensor, an opening signal is sent out to the electromagnetic valve 3 at a certain interval of time by utilizing a delay relay or a timer.

Figure 3:
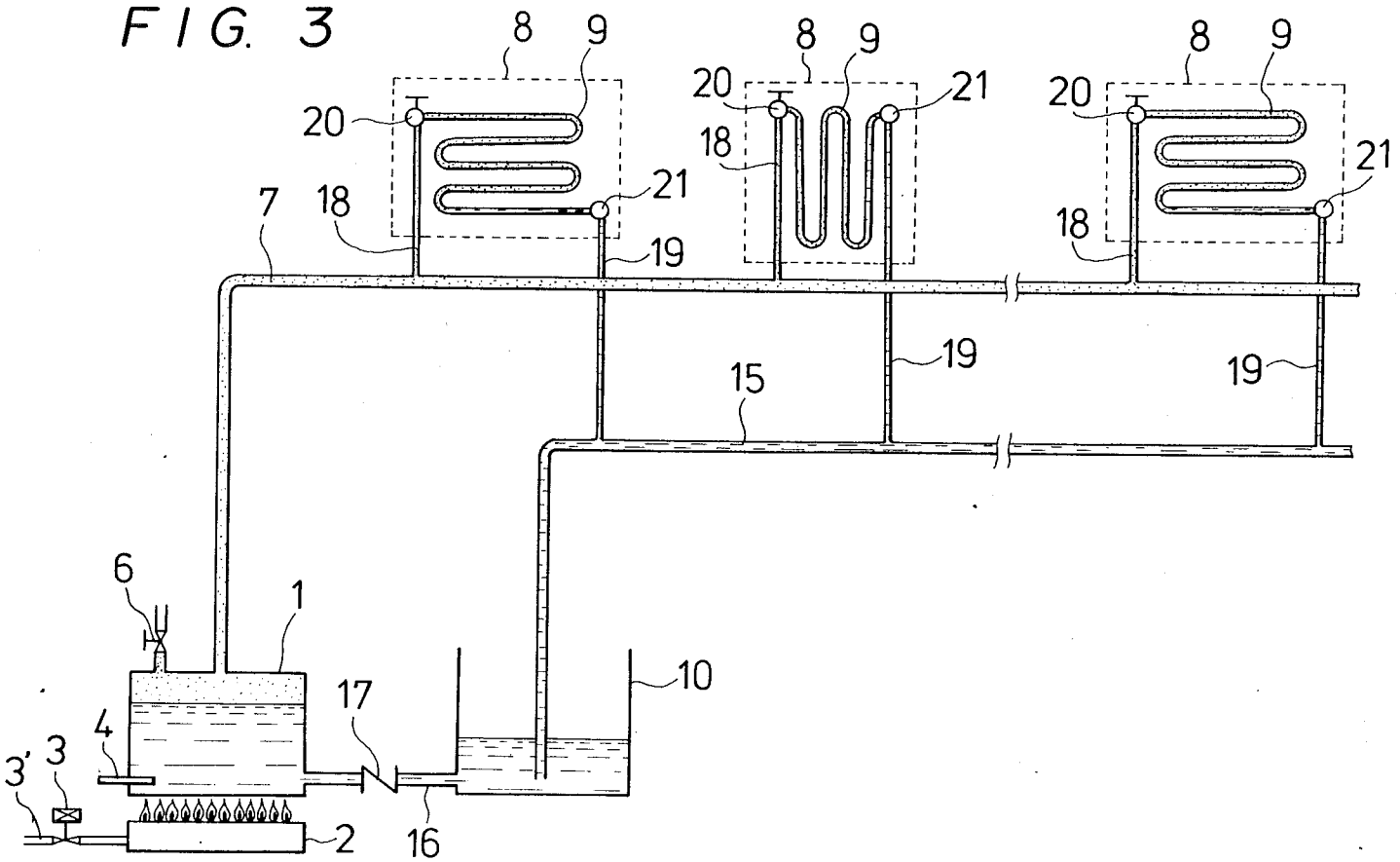
FIG. 3 is a diagram of another embodiment of the invention employing multiple radiator units.

FIG. 3 shows an example of the invention which includes multiple units of heat radiators such as heat emitters, where the symbol 1 stands for a steam generator, 2 a heating source, 4 the low liquid level sensor fitted to the inside of steam generator 1, 6 a safety valve, 7 the steam conducting tube for sending out the saturated steam generated in steam generator 1, 18 a branched steam conducting tube branching from the steam conducting tube 7, 8 a radiator, and 9 a heat transfer tube. The inlet side of this heat transfer tube 9 is connected to the aforesaid branched steam conducting tube 18. The symbol 20 represents a regulation valve, 21 a heat type trap, 19 a condensed liquid branch tube connected to the outlet side of heat the transfer tube 9, and 15 a condensed liquid main pipe, where all the aforesaid condensed liquid branch tubes 19 are connected to this condensed liquid main pipe 15. The symbol 10 stands for the condensed liquid vessel in which the end of the aforesaid condensed liquid main pipe 15 has been inserted into the interior. The liquid circulation tube 16 connects the interior of steam generator 1 with the condensed liquid vessel 10, and 17 is the check valve installed in this liquid circulation tube 16, which is of the ordinarily closed type. When the pressure inside steam generator 1 has fallen, check valve 17 is released to the side of steam generator 1. The symbol 3 represents the electromagnetic valve for the fuel line 3' of heater 2.

In operation, when the electromagnetic valve 3 is opened for starting the operation of the equipment, the heating source 2 is actuated to generate saturated steam inside steam generator 1, and this saturated steam reaches the heat transfer tube 9 within each radiator 8 through the steam conducting tube 7 and branches 18, where it gives its latent heat to the fluid (air) in the surroundings and is condensed, while the condensed liquid flows into the condensed liquid main pipe 15 through condensed liquid branch tubes 19 and enters into and is stored at the interior of condensed liquid vessel 10. The heating is advanced under this sort of process, and when the liquid level inside steam generator 1 has gone down, the low liquid level sensor 4 detests it to send an OFF signal to the electromagnetic valve 3 to cause it to switch to its OFF position. The action of heating source 2 comes to a stop when the electromagnetic valve 3 is set to its OFF position. The walls of steam generator 1 cool when the operation of heating source 2 is stopped,. and the internal steam is condensed to cause the interior of steam generator to be under partial vacuum. The condensed liquid stagnant inside the condensed liquid vessel 10 flows back, due to this vacuum action, to the interior of steam generator 1 through the liquid circulation tube 16 over valve 17, and when the liquid level inside steam generator has gone up again, an ON signal is transmitted to the electromagnetic valve 3 for starting the operation of heating source 2. The heating is carries out through the repetition of this process.

Figure 4:
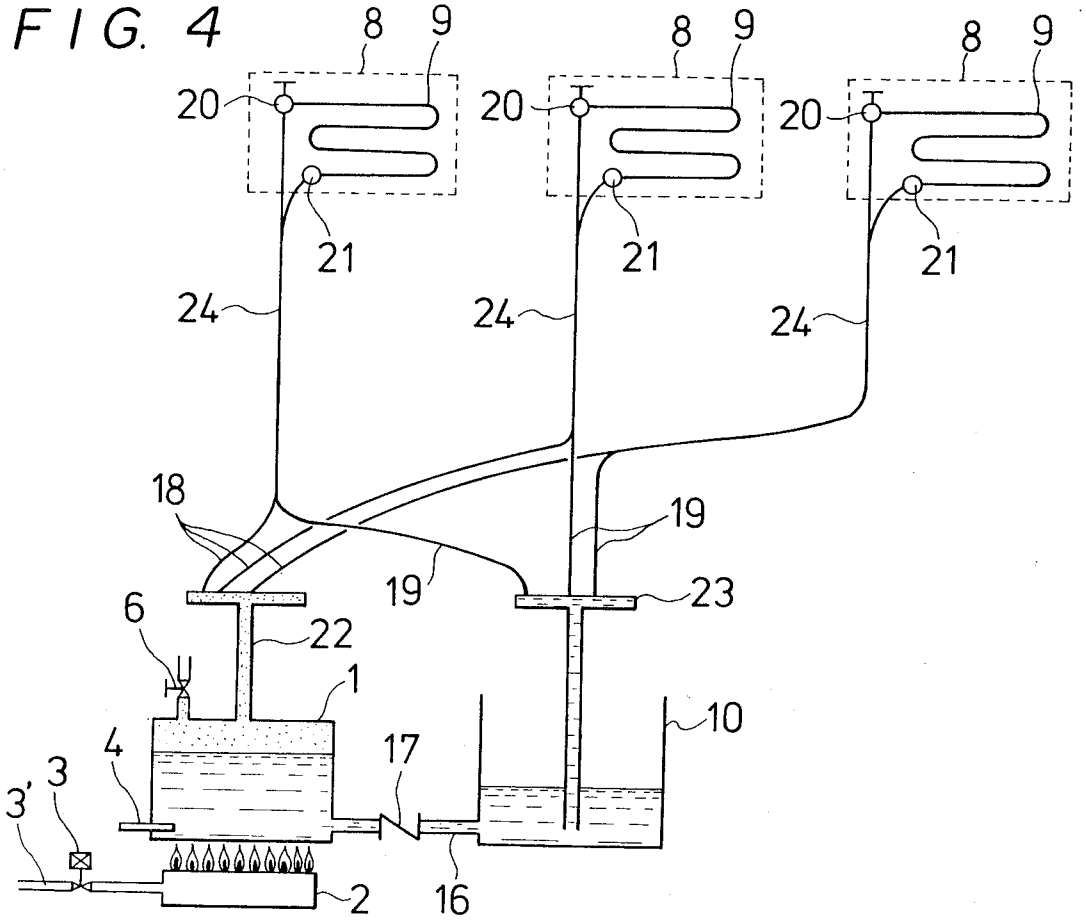
FIG. 4 is a diagram of a still further embodiment of the invention which has been structured in a way where headers and flexible pairs of tubes (two tubes having been integrated into a single one) are used for a plural number of radiators for sending out the steam, and wherein the condensed liquid is recovered into a condensed liquid vessel with the use of the pairs of tubes and the headers.

FIG. 4 shows an example of the invention where a header 22, replacing steam conducting tube 7, is installed on the steam generator 1, the steam is sent to each radiator 8 from this steam header 22 via pair tubes 24 as branch steam conducting tubes and condensed liquid branch tubes 19, while the condensed liquid respectively enters a condensed liquid header 23, replacing the condensed liquid main pipe 15, installed on the condensed liquid vessel 10 through the aforesaid pair tubes 24.

Furthermore, the check valve 17 can be of the automatic control type to which a signal is sent by a low liquid level sensor 4 for starting the operation. If a single unit out of several radiators 8 alone is to be put in service, the pressure inside the steam generator becomes excessively high, so in such an event, it is necessary to detect the pressure inside steam generator 1 for controlling the electromagnetic valve 3 and to suppress the generated volume of steam. Furthermore, since the saturated steam is to be generated inside the steam generator 1, it is acceptable to detect the temperature instead of the pressure within steam generator 1.

The structure and action of the present invention is as aforementioned, and the following effects can be obtained.

a. As the steam is sent to the heat emitter by utilizing the saturated steam pressure which is generated by the steam generator, a heat transport can be attained freely without any driving power even if the pressure loss of the steam conducting pipe is great.

As a result, the diameter of the steam conducting tube can be made smaller, for instance, to an inside diameter of about 5 mm and the tube can be made more flexible, so the piping can be made at optional positions and directions, offering a extremely enhanced work execution property.

b. Since the pressure loss can be at a larger value, the diameter of the heat transfer tube inside the heat emitter can be made smaller, and hence it is possible to design the heat emitter in more compact style and more flat style.

c. Because the pressure loss of the pipe line can be at a larger value, there is a greater freedom in installing the heat emitter and the steam generator.

d. The liquid circulation time can be shortened due to the provision of the liquid circulation tube, and the heat transport rate per unit time can be raised by that portion. This effect becomes greater especially in the event of arranging the steam generator and the condensed liquid vessel closer to each other.

e. Because of the provision of the liquid circulation tube, most of the condensed liquid inside the condensed liquid vessel returns to the side of steam generator via this liquid circulation tube and tends to by-pass the heat emitter, so the heating effect can not be impaired even though the temperature of the condensed liquid is rather low.

f. Since, even with multiple heat emitters, the condensed liquid vessel has been integrated into a single unit where the liquid is once stored via the condensed liquid branch tubes and the condensed liquid main pipe for feeding back the liquid to the steam generator via the liquid circulation tube, the steam generator and the condensed liquid vessel can be brought closer to each other. As a result, the liquid circulation time can be greatly shortened.

g. In the event of plural heat emitters, these heat emitters can be moved freely by isolating the condensed liquid vessel from the heat emitter as one common to the respective heat emitters.

While specific embodiments of the invention have been shown and described in detail to illustrate the application of the principles of the invention, it will understood that the invention may be embodied otherwise without departing from such principles.

What is claimed is:

1. A heating system comprising a steam generator defining a space for receiving a liquid to be converted into saturated steam, a heating source associated with said steam generator for heating said steam generator to generate saturated steam therein, a steam conducting tube connected to said heat generator for conveying saturated steam, a heat emitter having a heat transfer tube connected to said steam conducting tube for receiving saturated steam to heat surroundings of said heat transfer tube whereby saturated steam in said heat transfer tube is condensed back to liquid after it gives up its heat to the surroundings, a condensed liquid vessel connected to said heat transfer tube for receiving condensed liquid and subjecting the condensed liquid to atmospheric pressure, a liquid circulation tube connected directly between said vessel and said steam generator for supplying condensed liquid from said vessel to said steam generator, valve means in said liquid circulation tube for passing liquid from said vessel to said gas generator only, and control means for intermittently activating said heating source for generating saturated steam which is supplied to said heat transfer tube for giving up its latent heat and being condensed into liquid which is supplied to said liquid vessel, said steam generator cooling with said heating source deactivated to effect a reduction of pressure in said steam generator to draw liquid from said vessel to said steam generator over said circulation tube and through said valve means.

2. A method of operating a heating system having a steam generator, a heating source for heating the steam generator to generate steam from a liquid in said steam generator, and a heat transfer tube acting as a heat emitter for receiving steam from the steam generator, comprising activating the heating source to generate steam in said steam generator from liquid in said steam generator supplying the steam to the heat transfer tube whereat the steam gives up its latent heat to condense back into liquid. supplying the condensed liquid from the heat transfer tube to a condensed liquid vessel which subjects the liquid in the vessel to atmospheric pressure, deactivating the heating source to allow the steam generator to cool which produces a partial vacuum in the steam generator as steam condenses in the steam generator, supplying liquid from the vessel directly to the steam generator over a one-way valve while the heating source is deactivated for replenishing liquid in the steam generator, and reactivating the heating source for again generating steam from the liquid in the steam generator.

3. A heating system according to claim 1, including a branch connection line connected between said liquid circulation tube and said steam conducting tube near a mid-point of said steam conducting tube between said steam generator and said heat transfer tube.

4. A heating system according to claim 1, wherein said valve means comprises a check valve which automatically supplied liquid from said vessel to said steam generator with reduction of pressure in said steam generator below atmospheric pressure, and blocks passage of liquid from steam generator back to said vessel.

5. A heating system according to claim 4 including a plurality of heat emitters each with a heat transfer tube, a steam conducting branch tube connected between said steam conducting tube and each heat transfer tube and a condensed liquid branch tube connected between each heat transfer tube and said condensed liquid vessel.

6. A heating system according to claim 4, wherein said control means includes a low liquid level sensor in said steam generator and outwardly connected to said heating source for deactivating said heating source when liquid in said steam generator falls to said sensor.

7. A method according to claim 2, including sensing the level of liquid in the steam generator and deactivating the heating source to allow the steam generator to cool when the liquid level falls below a predetermined low level.

* * * * *